United States Patent [19]

Hester et al.

[11] Patent Number: 4,771,228

[45] Date of Patent: Sep. 13, 1988

[54] OUTPUT STAGE CURRENT LIMIT CIRCUIT

[75] Inventors: Richard E. Hester, Eden Prairie; Tuan Ngo, Minneapolis, both of Minn.

[73] Assignee: VTC Incorporated, Bloomington, Minn.

[21] Appl. No.: 58,770

[22] Filed: Jun. 5, 1987

[51] Int. Cl.[4] ..... G05F 3/26

[52] U.S. Cl. ..... 323/315; 323/314; 307/297

[58] Field of Search ..... 323/312, 313, 314, 315; 307/297

[56] References Cited

U.S. PATENT DOCUMENTS

| | | | |
|---|---|---|---|
| 3,996,498 | 12/1976 | Schade, Jr. | 323/315 X |
| 4,085,359 | 4/1978 | Ahmed | 323/314 |
| 4,268,789 | 5/1981 | Nagano | 323/315 |
| 4,319,181 | 3/1982 | Wrathall | 323/315 |
| 4,352,056 | 9/1982 | Cave et al. | 323/314 |
| 4,399,375 | 8/1983 | Sempel | 307/297 |
| 4,442,411 | 4/1984 | Gehring | 330/296 |
| 4,553,084 | 11/1985 | Wrathall | 323/314 X |
| 4,591,780 | 5/1986 | Yamada et al. | 323/313 |
| 4,612,497 | 9/1986 | Ulmer | 323/315 |

FOREIGN PATENT DOCUMENTS

| | | | |
|---|---|---|---|
| 0853622 | 8/1981 | U.S.S.R. | 323/315 |

*Primary Examiner*—Patrick R. Salce
*Assistant Examiner*—Kristine Peckman
*Attorney, Agent, or Firm*—Kinney & Lange

[57] ABSTRACT

An amplifier output stage includes current limiting circuitry for limiting the current in the output stage if the output terminal is shorted to ground. The current sinking and the current sourcing output transistors each have a current limiting circuit which mirrors the collector current of the output transistor, produces a voltage which is a function of the mirrored collector current, and controls base current to the output transistor as a function of the voltage. The output current limiting function, therefore, is provided without sacrificing output voltage swing of the output stage.

10 Claims, 2 Drawing Sheets

OUTPUT STAGE CURRENT LIMIT CIRCUIT

BACKGROUND OF THE INVENTION

1. Field of the Invention

The present invention relates to an amplifier output stage, and in particular to current limiting circuitry for protecting the output stage against damage when the output terminal is shorted to ground.

2. Description of the Prior Art

In the output stages of operational amplifiers and other circuits, it is often necessary to provide a circuit which will limit the current in the output stage if the output is shorted to ground. If a current limit circuit is not provided, and the output is shorted to ground, the output stage will often supply several hundred milliamps of current. This can cause the entire circuit to be destroyed. For this reason, commercially available operational amplifiers typically have current limit circuits. These current limit circuits work well to limit the current, but also take away from the available voltage swing for the output stage.

The sacrifice of some output swing to accommodate current limit protection has not been a significant factor in many of the prior art operational amplifiers which use ±15 volt power supplies. Where lower supply voltages are desired (such as ±5 volts), however, the voltage drop across a resistor connected in series with the collector/emitter current path of the output transistors can significantly limit the amount of available output swing.

SUMMARY OF THE INVENTION

In the amplifier output stage of the present invention, current limiting is provided without sacrificing output swing, because the current is not sensed by a resistor connected in series with the collector/emitter of the output transistors. Instead, the collector current of the output transistors is sensed using a current mirror circuit, the mirrored current is converted to a voltage, and a current limit transistor which is connected to the base of the output transistor controls base current as a function of the voltage to limit the collector current of the output transistor.

DETAILED DESCRIPTION OF THE PREFERRED EMBODIMENTS

Figure 1:
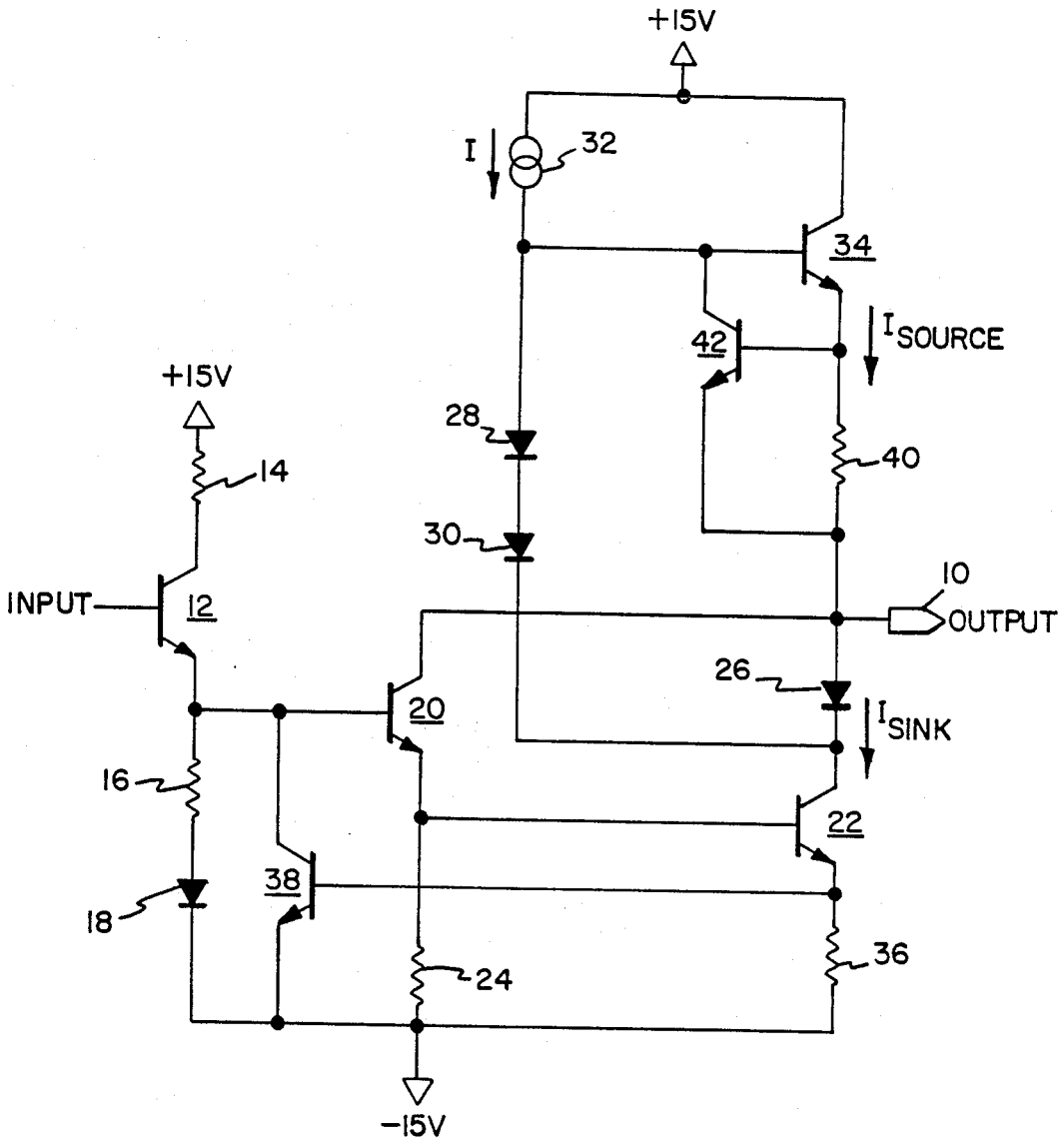
Fig.1 PRIOR ART
FIG. 1 shows a prior art operational amplifier output stage having a current limit circuit.

Before discussing the improved output stage of the present invention, a review of a typical prior art operational amplifier output stage with current limiting circuitry will be helpful. FIG. 1 shows such a prior art circuit, which is similar to the PMI OP50 operational amplifier output stage. As shown in FIG. 1, the operational amplifier output stage uses a +15 volt and −15 volt supply. An input is received from prior stages of the amplifier (not shown) and the output signal appears at output terminal 10.

An input signal is supplied to the base of NPN transistor 12. Resistor 14 is connected between the collector of transistor 12 and the +15 volt supply. The emitter of transistor 12 is connected through resistor 16 and diode 18 to the −15 volt supply.

Connected to the emitter of transistor 12 is a current sink circuit which includes NPN transistor 20, NPN transistor 22, resistor 24 and diode 26. Transistor 20 has its base connected to the emitter of transistor 12, its collector connected to output terminal 10, and its emitter connected through resistor 24 to the −15 volt supply. Transistor 22 is connected in emitter/follower relation to transistor 20, with its base connected to the emitter of transistor 20 and its collector connected through diode 26 to output terminal 10.

As the input voltage at the base of transistor 12 increases (i.e. becomes more positive), transistor 12 turns on harder, thus increasing the base current to transistor 20. That in turn increases the emitter current of transistor 20 and turns on transistor 22 harder. This increases the amount of current $I_{SINK}$ which is flowing from the output terminal 10 through diode 26 and the collector-/emmitter current path of transistor 22. Conversely, as the input voltage at the base of transistor 12 goes down, transistor 20 and transistor 22 have their base currents decreased, which causes $I_{SINK}$ to decrease.

Connected between +15 volt supply and output terminal 10 is a current source circuit which supplies current $I_{SOURCE}$ to output terminal 10. The current source circuit includes diodes 28 and 30, current source 32 and NPN transistor 34. The base current to output transistor 34 is determined by the amount of current flowing from current source 32 through diodes 28 and 30 to the collector of transistor 22. In other words, the drive to transistor 22 determines the drive to transistor 34 so that as $I_{SINK}$ decreases, $I_{SOURCE}$ increases, and vice versa.

Both the current sink circuit and the current source circuit include current limiting circuitry which protect the output stage if output terminal 10 is shorted to ground. The current limiting circuitry for the current sink circuit includes rsistor 36 and NPN transistor 38. For current source circuit, the current limit circuit includes resistor 40 and NPN transistor 42.

If output terminal 10 is shorted to ground and the output stage is sinking current, then a voltage is developed across resistor 36. As the output current increases, the voltage drop across resistor 36 increases until transistor 38 begins to turn on. As transistor 38 turns on harder, it will pull current away from the base of transistor 20, which will limit its collector current. This will limit the current to the base of transistor 22, which will limit the collector current of transistor 22 (which is the output current). Under normal operation, at maximum output current, there will be about 0.6 volts across resistor 36 which subtracts directly from the output swing.

If the output is shorted to ground and the output stage is sourcing current, then a voltage is developed across resistor 40. As the output current increases, the voltage drop increases until transistor 42 turns on. Eventually, transistor 42 will turn on hard enough so that the base current to transistor 34 is limited. Limiting the base current to transistor 34 will also limit the emitter current of transistor 34, which is also the output current. Under normal operation, at maximum output current, there will be about 0.6 volts across resistor 40 which subtracts directly from the output swing.

Figure 2:
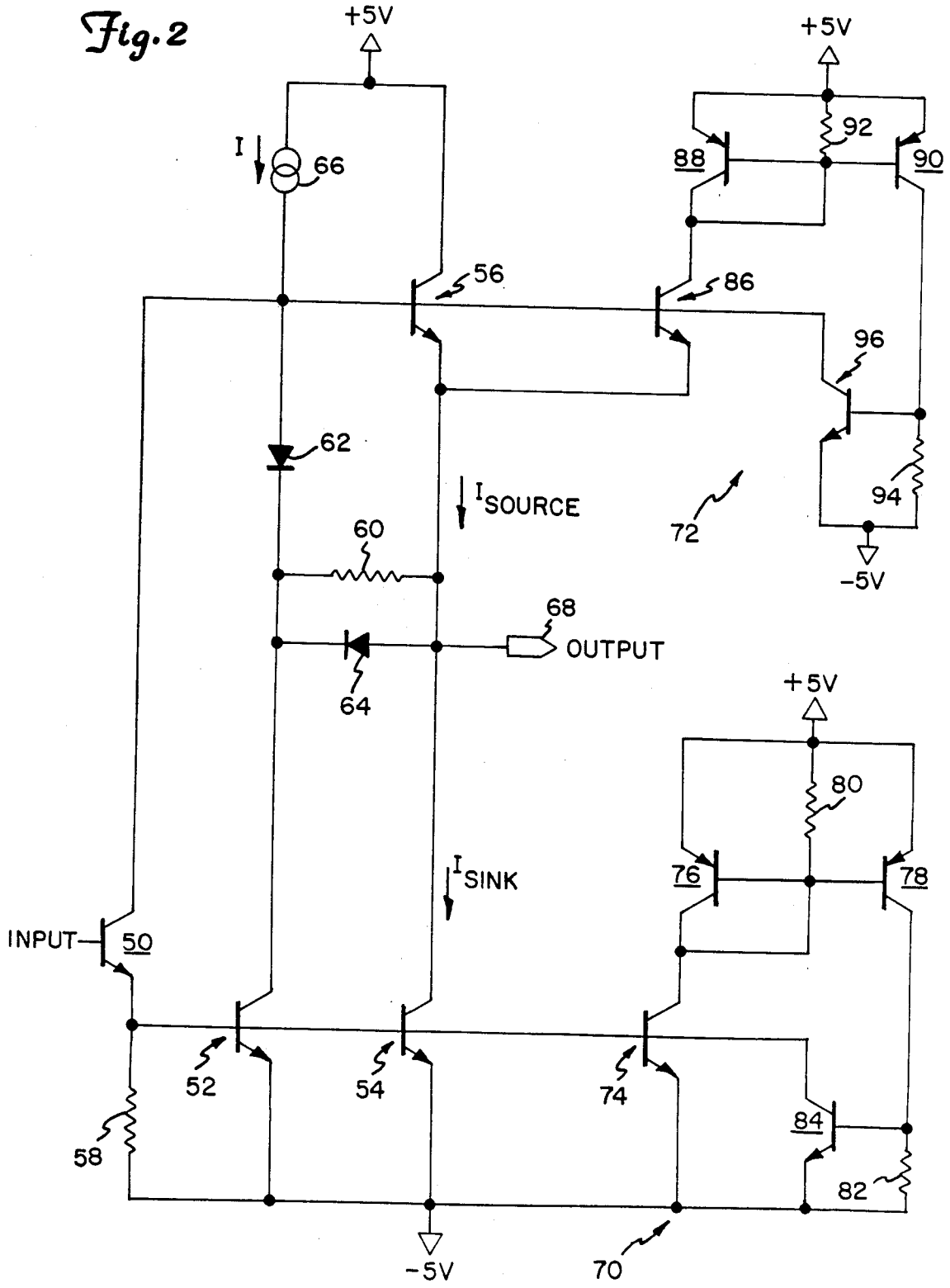
FIG. 2 is an electrical schematical diagram of an embodiment of the output stage of the present invention which includes current limiting circuitry which does not sacrifice output swing.

FIG. 2 is a schematic diagram of a preferred embodiment of the output stage of the present invention, in which output current limiting is achieved without sacrificing output voltage swing. The output stage includes NPN transistor 50, which receives the input signal at its base, NPN transistors 52, 54 and 56, resistors 58 and 60, diodes 62 and 64, and current source 66. Current is sourced to putput terminal 68 through output transistor 56, and current is sunk from output terminal 68 by output transistor 54. The output stage shown in FIG. 2 also includes current limit circuits 70 and 72, which limit the current being sunk through output transistor 54 or being sourced through output transistor 56, respectively.

Current limit circuit 70 includes NPN transistor 74 which is connected in current mirror relationship with output transistor 54, a current mirror formed by PNP transistors 76 and 78 and resistor 80, current sensing resistor 82, and base current control NPN transistor 84.

Similarly, current limit circuit 72 includes NPN transistor 86 which is connected in current mirror relationship to output transistor 56, a current mirror formed by PNP transistors 88 and 90 and resistor 92, current sensing resistor 94, and a base current control NPN transistor 96.

Transistor 74 of current limit circuit 70 has, in a preferred embodiment, an emitter which is about 1/50th the size of the emitter of output transistor 54. Similarly, transistor 86 has an emitter which is about 1/50th the size of the emitter of output transistor 56. Thus the mirrored current in the collector of transistor 74 is 1/50th the collector current $I_{SINK}$ of transistor 54. Similarly, the mirrored current in the collector of transistor 56 is about 1/50th the collector current of output transistor 56 (and thus about 1/50th of $I_{SOURCE}$).

The mirrored current in the collector of transistor 74 is mirrored again by transistors 76 and 78 and resistor 80, and that mirrored current is supplied to resistor 82. Similarly, the collector current of transistor 86 is mirrored by transistors 88 and 90 and resistor 92 and supplied to resistor 94.

When current is being sunk from output terminal 68 and output terminal 68 is grounded, current $I_{SINK}$ through output transistor 54 increases, which increases the mirrored collector current of transistor 74. This in turn increases the current being supplied to resistor 82. The increasing voltage produced across resistor 82 turns on transistor 84, which has its collector connected to the base of output transistor 54 and its emitter connected to the −5 V supply. Thus as transistor 84 turns on, it limits the base current to output transistor 54.

Similarly, if current is being sourced to output terminal 68, and output terminal 68 is shorted to ground, the increasing current through output transistor 56 results in an increase in the mirrored current in the collector of transistor 86. That in turn results in an increase in current to resistor 94. When the current becomes excessive, transistor 96 turns on, thereby limiting the base current to output transistor 56.

The output stage of the present invention, as illustrated in FIG. 2, senses the current being sunk or sourced through the output transistors 54 and 56 and limits base current to the output transistors 54 and 56 without introducing a voltage drop in the current path which would result in a sacrifice in output voltage swing. Instead, the current is sensed by mirroring the output current, converting that mirrored current to a voltage, and controlling a transistor which limits base current to the output transistor 54 or 56 in order to provide output current limiting which will protect the circuit from damage in the event that output terminal 68 is shorted to ground.

Although the present invention has been described with reference to preferred embodiments, workers skilled in the art will recognize that changes may be made in form and detail without departing from the spirit and scope of the invention.

What is claimed is:

1. An amplifier output stage comprising:

first output transistor means having a base, an emitter and a collector for controlling current flow;

first current mirror transistor means connected in parallel to the first output transistor means for providing a first mirrored collector current which is a function of collector current of the first output transistor means;

means for producing a first voltage which is a function of the first mirrored collector current; and first current limit transistor means connected to the base of the first output transistor means for controlling base current to the first output transistor means as a function of the first voltage to limit the collector current of the first output transistor means.

2. The amplifier output stage of claim 1 wherein the means for producing a first voltage comprises:

current mirror means for mirroring the first mirrored collector current; and resistor means connected to the current mirror means for producing the first voltage as a function of current flowing therethrough.

3. The amplifier output stage of claim 1 and further comprising:

an output terminal;

first and second power supply terminals; and wherein the first output transistor means has its emitter and collector connected in a current path between the first power supply terminal and the output terminal.

4. The amplifier output stage of claim 3 and further comprising:

second output transistor means for controlling current flow and having a base and having an emitter and a collector connected in a current path between the output terminal and the second power supply terminal;

second current mirror transistor means connected in parallel to the second output transistor means for providing a second mirrored collector current which is a function of the collector current of the second output transistor means;

means for producing a second voltage which is a function of the second mirrored collector current; and second current limit transistor means connected to the base of the second output transistor means for controlling base current to the second output transistor means as a function of the second voltage to limit the collector current of the second output transistor means.

5. The amplifier output stage of claim 4 wherein the first and second output transistor means and the first and second current mirror transistor means are bipolar transistors of first conductivity type.

6. The amplifier output stage of claim 5 wherein the first and second current limit transistor means are bipolar transistors of the first conductivity type.

7. The amplifier output stage of claim 5 wherein the first conductivity type is NPN.

8. An amplifier output stage comprising:

first and second power supply terminals;

an output terminal;

a current source circuit connected between the first power supply terminal and the output terminal for sourcing a first current to the output terminal, the current source circuit including a first output transistor having a base and having an emitter-collector current path through which the first current flows;

a current sink circuit connected between the second power supply terminal and the output terminal for sinking a second current from the output terminal, the current sink circuit including a second output transistor having a base and having an emitter-collector current path through which the second current flows;

a first current limit circuit for limiting the first current including a first current sensing transistor connected in parallel to the first output transistor for producing a first mirror current which is a function of the first current; means for producing a first voltage as a function of the first mirror current; and means for controlling base current of the first output transistor as a function of the first voltage; and a second current limit circuit for limiting the second current including a second current sensing transistor connected in parallel to the second output transistor for producing a second mirror current which is a function of the second current; means for producing a second voltage as a function of the second mirror current; and means for controlling base current of the second output transistor as a function of the second voltage.

9. The amplifier output stage of claim 8 wherein the first and second output transistors and the first and second current sensing transistors are NPN transistors.

10. The amplifier output stage of claim 9 wherein the means for controlling base current of the first output transistor and the means for controlling base current of the second output transistor comprise NPN transistors.

* * * * *